United States Patent [19]

Gruber et al.

[11] Patent Number: 4,792,513

[45] Date of Patent: Dec. 20, 1988

[54] POSITIVELY CHARGED TONER COMPOSITIONS

[75] Inventors: Robert J. Gruber, Pittsford; Robert A. Nelson, Webster, both of N.Y.

[73] Assignee: Xerox Corporation, Stamford, Conn.

[21] Appl. No.: 45,641

[22] Filed: May 4, 1987

[51] Int. Cl.[4] ..... G03G 9/00

[52] U.S. Cl. ..... 430/110; 430/107; 430/109

[58] Field of Search ..... 430/107, 106, 108, 109, 430/110, 126

[56] References Cited

U.S. PATENT DOCUMENTS 4,456,624 12/1985 Gruber et al. ..... 430/110
4,486,524 12/1984 Fujisaki et al. ..... 430/109
4,499,168 2/1985 Mitsuhashi ..... 430/99
4,564,573 1/1986 Morita et al. ..... 430/109
4,604,338 8/1986 Gruber et al. ..... 430/110

*Primary Examiner*—John L. Goodrow
*Attorney, Agent, or Firm*—E. O. Palazzo

[57] ABSTRACT

A positively charged toner composition comprised of resin particles exhibiting a peak value molecular weight in each of the molecular weight regions of from about 5,000 to about 80,000, and from about 100,000 to about 2,000,000; a wax component with a weight average molecular weight of from about 500 to about 10,000; and a charge enhancing additive selected from the group consisting of alkyl pyridinium halides, organic sulfonates, organic sulfates, distearyl dimethyl ammonium methyl sulfate, behenyl trimethyl ammonium methyl sulfate, and distearyl methyl ethyl ammonium ethyl sulfate.

31 Claims, No Drawings

POSITIVELY CHARGED TONER COMPOSITIONS

BACKGROUND OF THE INVENTION

This invention is generally directed to positively charged toner compositions, and more specifically, the present invention is directed to positively charged toner compositions containing a low molecular weight wax such as polyethylene or polypropylene, and a charge enhancing additive. In one embodiment, the present invention is directed to a toner composition comprised of one or more polymeric resins exhibiting peak value molecular weights in the molecular weight regions of $5\times10^3$ to $8\times10^4$, and $10^5$ to $2\times10^6$, respectively, as measured by gel permeation chromotography (GPC); a low molecular weight wax component pigment particle; and a charging enhancing additive. These compositions are particularly useful for permitting the development of images, including colored images in electrophotographic imaging processes wherein an offset preventing liquid, such as a silicon oil, is not required.

Developer compositions with additives, which impart a positive charge to the toner resin, are well known. Thus, for example, there are described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica. Additionally, in U.S. Pat. No. 3,893,935 there is described the utilization of certain quaternary ammonium salts as charge control agents for electrostatic toner compositions. There are also described in U.S. Pat. No. 4,298,672 positively charged toner compositions with resin particles and pigment particles; and as a charge enhancing additive alkyl pyridinium compounds and their hydrates, inclusive of cetyl pyridinium chloride.

In addition, positively charged colored toner compositions are illustrated in U.S. Pat. No. 4,604,338, the disclosure of which is totally incorporated herein by reference, which compositions are comprised of first resin particles; second crosslinked resin particles; colored pigment particles excluding black, and selected from the group consisting of, for example, cyan, magenta, yellow, blue, red, and brown; a low molecular weight wax; and a charge enhancing additive selected from the group consisting of alkyl pyridinium halides, organic sulfonate compositions, organic sulfate compositions, distearyl dimethyl ammonium methyl sulfate, behenyl trimethyl ammonium methyl sulfate, and distearyl methyl ethyl ammonium ethyl sulfate. Furthermore, illustrated in U.S. Pat. No. 4,556,624, the disclosure of which is totally incorporated herein by reference, are toner compositions with crosslinked resins, and low molecular weight wax components, as well as charge enhancing additives. The aforementioned compositions are useful in imaging systems wherein release oils such as silicones are not required.

There is illustrated in U.S. Pat. No. 4,564,573 a toner composition that includes as an essential component a binder resin comprised of at least 60 percent by weight of a styrene butadiene copolymer, which contains a component A with a molecular weight of at least 100,000; and wherein said component A contains a component B with a molecular weight of at least 50,000, reference column 3, at line 50. Additive such as coloring agents and charge control agents may be incorporated into the toner compositions illustrated in this patent. Also of interest is the disclosure in column 3, line 62, and continuing on to column 4. According to the disclosure of this patent, the toners illustrated have adequate flowability, and noncoagulation properties, and are capable of forming superior visable images with heat fixing processes. Moreover, there are illustrated in U.S. Pat. No. 4,486,524 toner compositions comprised of resin particles containing at least 60 percent by weight of specific polymers selected from, for example, copolymers of aromatic vinyl monomers with at least one other alpha-methylene aliphatic monocarboxylic acid ester, which polymer has a weight average molecular weight number average molecular weight ratio of from 3.5 to 40, and wherein the number average molecular weight is between 2,000 and 30,000. This patent also discloses a toner composition wherein the resin selected is preferably comprised of a low molecular weight polymer, for example molecular weight between 100,000 and 500,000, and a low molecular weight polymer with a molecular weight of not more than 30,000, reference column 4, lines 1 to 6, which toner can be utilized for preventing offsetting, reference column 5, lines 34 to 36. This toner may also include therein charge controlling agents and plasticizers, reference column 14, lines 9 to 12.

Of particular interest with respect to the subject matter of the present application is U.S. Pat. No. 4,499,168, the disclosure of which is totally incorporated herein by reference, which illustrates developer powders comprising one or more vinyl type copolymers exhibiting a peak value molecular weight in each of the molecular weight regions of $5\times10^3$ to $8\times10^4$, and $10^5$ to $2\times10^6$, respectively, as measured by gel permeation chromotography, and an ethylene type olefin homo, or copolymer with a melt viscosity of for, example, 10 centipoises at 14° C. The aforementioned compositions are useful in xerographic imaging systems wherein fusing is accomplished with no silicone oils, reference column 3, line 54. Specific embodiments of toner compositions illustrated in this patent are described in column 4, line 14, and continuing on to column 6, line 68. Moreover, as indicated in column 7, line 64, suitable type ethylene olefins that may be selected are polyethylene, polypropylene, and the like. In addition, in column 7, line 15, it is stated that the toner selected for the present invention can have incorporated therein various additive materials for the purpose of coloring, charge control, and the like. Additives described include carbon black, iron black, graphite, nigrosine, metal complexes of monoazo dyes, and others, reference column 7, line 18, and continuing on to line 33. This patent is silent, however, with respect to formulating positively charged toner compositions, especially containing specific charge enhancing additives, the subject matter of the invention of the present application.

With further respect to the prior art, it is know that to substantially eliminate offsetting, and more specifically for the purpose of preventing adhesion of the toner particles to the surface of the fixing roller there can be selected certain types of rollers, the surface of which may be covered with a thin film of an offset preventing liquid such as a silicone oil. These oils are highly effective, however, the apparatus within which they are incorporated is complicated and costly since, for example, a means for feeding the oil is required. Also, not only do the silicone oils emit an undesirable odor, they can deposit on machine components causing toner particles to adhere to the oils. An accumulation of toner particles on machine components is troublesome in that the image quality is adversely effected, and further these components must be periodically cleaned and/or replaced adding to the maintenance costs thereof. The aforementioned offsetting problems can be substantially eliminated with the black and magnetic toner compositions as disclosed in U.S. Pat. No. 4,460,672. This patent, the disclosure of which is totally incorporated herein by reference, illustrates positively charged toner compositions comprised of resin particles, pigment particles, a low molecular weight wax material, and a charge enhancing additive. More specifically, in one embodiment the U.S. Pat. No. 4,460,672 discloses a positively charged black toner composition comprised of resin particles containing polyester resins, styrene butadiene resins, or styrene butyl methacrylate resins; pigment particles; a low molecular weight waxy composition, such as a low molecular weight polyethylene or polypropylene; and a charge enhancing additive selected from the group consisting of alkyl pyridinium halides, organic sulfonate additives and organic sulfate additives. Also, there is described in copending application U.S. Ser. No. 655,381, entitled Toner Compositions With Crosslinked Resins and Low Molecular Weight Waxes, the disclosure of which is totally incorporated herein by reference, positively charged electrostatic toner compositions comprised of a polyblend mixture of a crosslinked copolymer composition, a second thermoplastic polymer, pigment particles, a charge enhancing additive, and a wax component. The aforementioned compositions are useful for affecting the development of images wherein offset preventing liquid such as a silicone oil is not required.

Accordingly, there is a need for positively charged toner compositions which can be selected for incorporation into electrostatographic imaging systems wherein offset preventing fluids such as silicone oils are not required. Additionally, there is a need for toner compositions that simultaneously possess acceptable developing characteristics, and excellent imaging fixing properties. There is also a need for positively charged toner compositions wherein offsetting of the toner image to the fuser roll is substantially eliminated. Additionally, there is a need for toner compositions wherein the toner is readily releasable from the carrier particles, the surface of the imaging member, and cleaning blades; and further a need for toner compositions that avoid and coagulation, and possess excellent fluidity and durability. There is also a need for positively charged toner compositions wherein imaging can be accomplished with coated hard fuser rolls, and substantially no offsetting results; and wherein layered imaging members are selected.

SUMMARY OF THE INVENTION

It is an object of the present invention to provide positively charged toner compositions, and developer compositions with the above noted advantages.

In another object of the present invention there are provided positively charged toner compositions which can be used in electrophotographic imaging systems without silicone oil release fluids.

In yet another object of the present invention there are provided positively charged toner compositions with low molecular weight waxes such as polyethylene and polypropylene, and charge enhancing additives.

It is an additional object of the present invention to provide methods for developing electrophotographic images with positively charged toner compositions, and wherein a silicone oil releasing fluid is not needed for preventing toner offsetting to the fuser rolls.

Furthermore, in another object of the present invention there are provided positively charged toner compositions, which contain therein resins comprised of one or more polymers exhibiting a peak value molecular weight in each of the molecular weight regions of of $5\times10^3$ to $8\times10^4$, and $10^5$ to $2\times10^6$, respectively, as measured by gel permeation chromotography.

Another object of the present invention resides in the provision of positively charged colored toner compositions containing one or more vinyl type copolymers exhibiting a peak value molecular weight in each of the molecular weight regions of $5\times10^3$ to $8\times10^4$, and $10^5$ to $2\times10^6$, respectively, as measured by gel permeation chromotography.

In yet another object of the present invention there are provided developers with positively charged toner compositions containing one or more vinyl type copolymers exhibiting a peak value molecular weight in each of the molecular weight regions of $5\times10^3$ to $8\times10^4$ (5,000 to 80,000), and $10^5$ to $2\times10^6$ (100,000 to 200,000), respectively, as measured by gel permeation chromotography; low molecular weight wax components; pigment particles; and charge enhancing additives.

These and other objects of the present invention are accomplished by providing developer compositions; and positively charged toner compositions comprised of at least one copolymer exhibiting a peak value molecular weight in each of the molecular weight regions of of $5\times10^3$ to $8\times10^4$, and $10^5$ to $2\times10^6$, respectively, as measured by gel permeation chromotography; a low molecular weight wax component; pigment particles; and a charge enhancing additive selected from the group consisting of alkyl pyridinium halides, especially cetyl pyridinium chloride, reference U.S. Pat. No. 4,298,672, the disclosure of which is totally incorporated herein by reference, organic sulfates, and sulfonates, especially stearylphenyl dimethyl ammonium tosylate, reference U.S. Pat. No. 4,338,390, the disclosure of which is totally incorporated herein by reference, and distearyl dimethyl ammonium methyl sulfate, reference U.S. Pat. No. 4,560,635, the disclosure of which is totally incorporated herein by reference. Also, in another embodiment the present invention is directed to positively charged toner compositions comprised of the resin particles indicated herein; colored pigment particles other than black, and selected from the group consisting of cyan, magenta, yellow, blue, red, brown, and green; a low molecular weight polyethylene or polypropylene composition; and a charge enhancing additive selected from the group consisting of alkyl pyridinium halides, organic sulfonate additives and organic sulfate additives.

Specific examples of charge enhancing additives selected for the compositions of the present invention include those of the following formulas:

I.

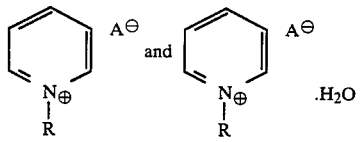

wherein R is a hydrocarbon group containing from about 8 to about 22 carbon atoms, and preferably from 12 to 18 carbon atoms; and A is an anion preferably selected from halides such as chloride, bromide, iodide, sulfate, sulfonate, nitrate, or borate;

II.

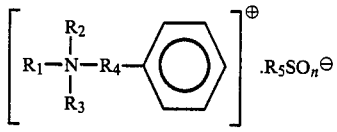

wherein $R_1$ is an alkyl group containing from about 12 carbon atoms to about 22 carbon atoms, and preferably from about 14 carbon atoms to 18 carbon atoms; $R_2$ and $R_3$ are independently selected from alkyl groups containing from about 1 carbon atom to about 5 carbon atoms; $R_4$ is an alkylene group containing from about 1 carbon atom to about 5 carbon atoms; $R_5$ is a tolyl group or an alkyl group containing from about 1 carbon atom to about 3 carbon atoms; and n is the number 3 or 4; and sulfate charge enhancing additives selected from the group consisting to distearyl dimethyl ammonium methyl sulfate, behenyl trimethyl ammonium methyl sulfate, and distearyl methyl ethyl ammonium ethyl sulfate.

Illustrative examples of hydrocarbon radicals for R, reference Formula I, include octyl, nonyl, decyl, myristyl, cetyl, oleyl, pentadecyl, heptadecyl, and octadecyl. Specific illustrative examples of alkyl pyridinium compounds include cetyl pyridinium chloride, heptadecyl pyridinium bromide, octadecyl pyridinium chloride, myristyl pyridinium chloride, and the corresponding hydrates.

Examples of alkyl groups for the compositions embraced by Formula II are methyl, ethyl, propyl, butyl, pentyl, hexyl, octyl, nonyl, decyl, myristyl, cetyl, oleyl, pentadecyl, heptadecyl, stearyl and the like. Preferred alkyl groups for $R_1$ include myristyl, stearyl, and cetyl, while preferred alkyl groups for $R_2$, $R_3$ and $R_5$ are methyl, ethyl and propyl. The preferred alkylene groups for $R_4$ are methylene and ethylene.

Specific illustrative examples of Formula II organic sulfonates and sulfates are stearyl benzyl ammonium para-toluene sulfonate, stearyl dimethyl phenethyl ammonium methyl sulfonate, stearyl dimethyl phenethyl ammonium para-toluene sulfonate, cetyl diethyl benzyl ammonium methyl sulfate, myristyl dimethyl penethyl ammonium paratoluene sulfonate, and cetyl diethyl benzyl ammonium methyl sulfate.

Various suitable resin particles can be selected providing that they exhibit a peak value molecular weight in each of the molecular weight regions of $5\times10^3$ to $8\times10^4$, and $10^5$ to $2\times10^6$ respectively as measured by gel permeation chromotography, which resins enable, for example, satisfactory offsetting properties, and provide low temperature fixing characteristics, which characteristics and properties are not readily obtainable with resins containing therein as a binder having only one peak in the referred to molecular weight distributions. More specifically, examples of the aforementioned resins include polyesters, diolefin polymers, styrene/methacrylate resins, polyamides, epoxies, polyurethanes, vinyl resins and polymeric esterification products of a dicarboxylic acid and a diol comprising a diphenol. Suitable vinyl resins include homopolymers or copolymers of two or more vinyl monomers. Examples of vinyl monomeric units are styrene, p-chlorostyrene, vinyl naphthalene, vinyl chloride, and ethylenically unsaturated mono-olefins such as ethylene, propylene, butylene, isobutylene and the like; vinyl esters such as vinyl acetate, vinyl propionate, vinyl benzoate, and vinyl butyrate; esters of alphamethylene aliphatic monocarboxylic acids inclusive of methyl acrylate, ethyl acrylate, n-butyl acrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, and acrylamide; vinyl ethers such as vinyl methyl ether, vinyl isobutyl ether, and vinyl ethyl ether; vinyl ketones like vinyl methyl ketone, vinyl hexyl ketone, and methyl isopropenyl ketone; styrene butadiene copolymers including suspension polymerized styrene butadienes; and mixtures thereof.

Specific preferred toner resins are selected from polystyrene methacrylate resins, polyester resins such as those described in U.S. Pat. Nos. 3,655,374 and 3,590,000, the disclosures of which are totally incorporated herein by reference; polyester resins resulting from the condensation of dimethylterephthalate, 1,3 butanediol, and pentaerythritol; and styrene butadiene copolymer resins, including those which are commercially available from Goodyear Corporation. The Pliolite resins are believed to be copolymer resins of styrene and butadiene, wherein the styrene is present in an amount of from about 80 weight percent to about 95 weight percent, and the butadiene is present in an amount of from about 5 weight percent to about 20 weight percent. A specific styrene butadiene resin found highly useful in the present invention is comprised of about 89 percent of styrene, and 11 percent of butadiene.

When mixtures of polymers are selected for the compositions of the present invention, there can be utilized from about 10 percent by weight to about 90 percent by weight of the first polymer, and from about 90 percent by weight to about 10 percent by weight of a second polymer. Additionally, mixtures in excess of two polymers can be selected providing the objectives of the present invention are achievable. With respect to the aforementioned embodiment of the present invention, when three polymers are selected the mixture may contain from about 10 to about 45 percent by weight of a first polymer, about 20 to about 35 percent by weight of a second polymer, and about 70 to about 20 percent by weight of a third polymer. Of importance with respect to the polymers is that they possess the peak value molecular weights described herein.

Numerous well known suitable pigments or dyes can be selected as the colorant for the toner particles including, for example, carbon black, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 3 percent by weight to about 20 percent by weight, based on the total weight of the toner composition; however, lesser or greater amounts of pigment particles can be selected providing the objectives of the present invention are achieved.

Various magnetites, which are comprised of a mixture of iron oxides, in most situations including those commercially available such as Mapico Black can be selected for incorporation into the toner compositions illustrated herein. The aforementioned pigment particles are present in various effective amounts, however, generally they are present in the toner composition in an amount of from about 15 percent by weight to about 25 percent by weight, and preferably in an amount of from about 16 percent by weight to about 19 percent by weight. Other magnetites not specifically disclosed herein may be selected provided the objectives of the present invention are achievable. Other magnetites can be selected for the toner and developer compositions of the present invention including brown magnetites, and magnetites commercially available as MO-4232 and 4235.

Colored pigment particles that may be incorporated into the toner compositions of the present invention are cyan, magenta, yellow, red, blue, brown and green. These pigments are generally present in the toner composition in an amount of from about 2 weight percent to about 15 weight percent based on the weight of the toner resin particles.

Illustrative examples of magenta, cyan and yellow pigments, or colorants selected for the toner compositions of the present invention are well known including, for example, the magenta compounds 2,9-dimethyl-substituted quinacridone and anthraquinone dye identified in the color index and Cl 60710; Cl Dispersed Red 15, a diazo dye identified in color index and Cl 16050; Cl Solvent Red 19; and the like. Examples of cyan materials that may be used as pigments include copper tetra-4(octadecyl sulfonamido) phthalocyanine; X-copper phthalocyanine pigment listed in the color index as Cl 74160; Cl Pigment Blue; and Anthrathrene Blue, identified in the color index and Cl 69810; Special Blue X-2137; and the like; while illustrative examples of yellow pigments that may be selected include diarylide yellow 3,3-dichlorobenzidene acetoacetanilides; a monazo pigment identified in the color index as Cl 12700; Cl Solvent Yellow 16; a nitrophenyl amine sulfonamide identified in the color index as Foron Yellow Se/GLN; Cl Dispersed Yellow 33, 2,5-dimethoxy-4-sulfonanilide phenylazo-4'-chloro-2,5-dimethoxy aceto-acetanilide; and Permanent Yellow FGL.

The waxy substances incorporated into the colored toner composition generally have a molecular weight of from between about 500 to about 20,000, and preferably is of a molecular weight of from about 1,000 to 6,000. Illustrative examples of low molecular weight waxy materials included within the scope of the present invention are polyethylenes, commercially available from Allied Chemical and Petrolite Corporation; Epolene N-15, commercially available from Eastman Chemical Products, Inc.; Viscol 550P, a low molecular weight polypropylene, available from Sanyo Kasei K.K.; and the like. The commercially available polyethylenes selected have a molecular weight of from about 1,000 to about 2,000, while the commercially available polypropylenes incorporated into the toner compositions of the present invention are of a molecular weight of about 4,000 to about 6,000. Many of the polyethylene and polypropylene compositions useful in the present invention are illustrated in British Patent No. 1,442,835, the disclosure of which is totally incorproated herein by reference.

Further, the aforementioned low molecular weight wax materials can be incorporated into the toner compositions in various amounts; however, generally these waxes are present in an amount from about 1 percent by weight to about 10 percent by weight, and preferably are present in an amount of from about 2 percent by weight to about 5 percent by weight. The blended charge enhancing additives are present in an amount of from about 0.5 percent to about 20 percent by weight, and preferably from about 1 percent by weight to about 5 percent by weight based on the total weight of the toner particles. Other amounts of waxes, and charge enhancing additives can be selected providing the objectives of the present invention are achievable.

Formulation of developers requires admixing with the aforementioned toner composition carrier particles that will enable the toner particles to become postively charged. Accordingly, as carrier cores there can be selected steel, nickel, iron ferrites and the like, with coatings thereover of fluoropolymers, such as polyvinylidene fluoride, copolymers of tetrafluoroethylenes and vinyl chloride; mixtures of fluoropolymers and polymethyl methacrylates; and the like. Specific examples of carriers that may be selected for the invention of the present application are illustrated in U.S. Ser. No. 751,922 entitled Developer Compositions with Specific Carrier Particles, the disclosure of which is totally incorporated herein by reference. Additionally, there can be selected nickel berry carriers as described in U.S. Pat. Nos. 3,847,604 and 3,767,598, the disclosures of which are totally incororated herein by reference. The diameter of the coated carrier particles is from about 50 microns to about 1,000 microns thus permitting the carrier particles to possess sufficient density and inertia to avoid adherence to the electrostatic images during the development process.

The carrier particles are mixed with the toner composition in various suitable combinations, however, best results are obtained with from about 1 part by weight to about 3 parts by weight of toner particles, with from about 100 parts to 200 parts by weight of carrier particles.

As indicated hereinbefore, the toner and developer compositions of the present invention are very useful for developing electrostatic latent images and colored images, particularly those present on imaging members charged negatively. When selecting the developing compositions of the present invention, it is not ncessary to utilize a release fluid, such as a silicone oil, to prevent toner offset since the compositions of the present invention prevent toner offset without a toner release fluid. Moreover, with respect to the toner compositions containing magnetites therein, there are enabled smudge-proof images and substantially no machine contamination when these compositions are incorporated into xerographic imaging apparatuses.

Examples of imaging that may be selected include various known photoreceptor compositions, particularly those which are negatively charged, which usually occurs with organic photoreceptors including layered photoreceptors. Illustrative examples of layered photoresponsive devices are comprised of a generating layer and a transport layer, as described in U.S. Pat. No. 4,265,990, the disclosure of which is totally incorporated herein by reference. Examples of generating pigments are trigonal selenium, metal phthalocyanines, metal free phthalocyanines, and vanadyl phthalocyanines. Transport materials that may be selected include various aryldiamines dispersed in resinous binders.

The imaging method of the present present invention thus involves the formation of a negatively charged electrostatic latent image on a suitable imaging member, contacting the image with the toner compositions of the present invention wherein the toner particles contain resin particles, pigment particles, a charge enhancing additive and a low molecular weight wax; followed by transferring the developed colored image to a suitable substrate such as paper; and permanently affixing the image thereto by various suitable means such as heat.

The following examples are being supplied to further define specific embodiments of the present invention, it being noted that these examples of intended to illustrate and not limit the scope of the present invention. Parts and percentages are by weight unless otherwise indicated.

EXAMPLE I

There was prepared by melt blending in a Banbury mixing device, maintained at 120° C., followed by mechanical attrition, a toner composition with 87.5 percent by weight of a styrene butadiene copolymer (91/9) exhibiting a peak value molecular weight in each of the molecular weight regions of 80,000 and 200,000, 5 percent by weight of the low molecular weight, less than 6,000, polypropylene wax commercially available as Viscol 550P from Sanyo Corporation; 6 percent by weight of Regal® 330 carbon black particles, and 1.5 percent by weight of the charge enhancing additive distearyl dimethyl ammonium methyl sulfate.

Thereafter, there was prepared a developer composition by admixing 1 part by weight of the above prepared toner with 100 parts by weight of carrier particles consisting of a tonolio steel core coated with 1.25 percent by weight of a copolymer of trifluoroethylene, and vinyl chloride (FPC-461). It is believed that the resulting toner composition had a triboelectric charge thereon of 18 microcoulombs per gram, which charge can be determined with a Faraday Cage apparatus. Moreover, the above prepared toner composition can be selected for developing images in xerographic imaging apparatuses wherein a negatively charged layered imaging member as illustrated in U.S. Pat. No. 4,265,990 is selected, and it is believed that images with acceptable resolutions, no background deposits and no offsetting can be obtained.

EXAMPLE II

A toner and developer composition can be prepared by repeating the procedure of Example I with the exception that there is utilized in place of the Regal® 330 carbon black 15 percent by weight of magnetite, and instead of 88 percent by weight of the copolymer there is selected 78.5 percent by weight of such a resin; and substantially similar results are obtainable. Also, with this composition it is believed that substantially no machine contamination will occur, that is the toner particles will not deposit on components present in the imaging apparatuses such as the optical means.

EXAMPLE III

A toner and developer composition can be prepared by repeating the procedure of Example I with the exception that there is selected 4 percent by weight of carbon black, and 15 percent by weight of magnetite in place of the 6 percent by weight of carbon black, and 74.5 percent by weight of the styrene butadiene copolymer; and substantially similar results are obtainable.

Other toner and developer compositions can be prepared by repeating the procedure of Example I with the exception that there is selected in place of the carbon black particles colored pigment particles; resins in addition to the styrene butadiene copolymers recited; and other charge enhancing additives as disclosed herein in place of the distearyl dimethyl ammonium methylsulfate.

Other modifications of the present invention will occur to those skilled in the art based upon a reading of the present disclosure. These are intended to be included within the scope of this invention.

What is claimed is:

1. A positively charged electrostatic toner composition comprised of resin particles exhibiting a peak value weight molecular weight in each of the molecular weight regions of from about 5,000 to about 80,000, and from about 100,000 to about 2,000,000 as determined by gel permeation chromotography, pigment particles; a wax component with a weight average molecular weight of from about 500 to about 10,000; and a charge enhancing additive selected from the group consisting of alkyl pyridinium halides, organic sulfonate compositions and organic sulfate compositions of the following formulas:

I.

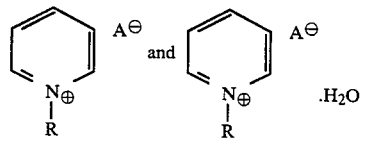

wherein R is a hydrocarbon group containing from about 8 to about 22 carbon atoms, and A is an anion;

II.

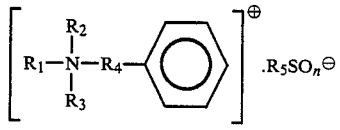

wherein $R_1$ is an alkyl group of from about 12 carbon atoms to about 22 carbon atoms, $R_2$ and $R_3$ are independently selected from alkyl groups containing from about 1 carbon atom to about 5 carbon atoms, $R_4$ is an alkylene group of from about 1 carbon atom to about 5 carbon atoms, $R_5$ is a tolyl group or an alkyl group of from about 1 carbon atom to about 3 carbon atoms, and n is the number 3 or 4; distearyl dimethyl ammonium methyl sulfate, behenyl trimethyl ammonium methyl sulfate, and distearyl methyl ethyl ammonium ethyl sulfate.

2. A toner composition in accordance with claim 1 wherein the resin particles are selected from the group consistig of polyesters, styrene butadiene copolymers, and styrene methacrylate copolymers.

3. A toner composition in accordance with claim 2 wherein the polyester results from the condensation reaction of dimethyl terephthalate, 1,3-butanediol, and pentaerythritol.

4. A toner composition in accordance with claim 2 wherein the styrene butadiene copolymer contains 89 percent by weight of styrene, and 11 percent of weight of butadiene.

5. A toner composition in accordance with claim 1 wherein the wax is selected from the group consisting of polyethylene and polypropylene.

6. A toner composition in accordance with claim 5 wherein the polyethylene or polypropylene are present in an amount of from about 1 percent by weight to about 10 percent by weight.

7. A toner composition in accordance with claim 1 wherein the charge enhancing additive is cetyl pyridinium chloride.

8. A toner composition in accordance with claim 1 wherein the charge enhancing additive is stearyl dimethyl phenethyl ammonium para-toluene sulfonate.

9. A toner composition in accordance with claim 1 wherein the wax is of a molecular weight of from about 500 to about 20,000.

10. A toner composition in accordance with claim 1 wherein the charge enhancing additive is present in an amount of from about 0.5 percent by weight to about 20 percent by weight.

11. A toner composition in accordance with claim 1 wherein the pigment articles are selected from the group consisting of carbon black, magnetites, cyan, magenta, yellow, red, blue green and mixtures thereof.

12. A toner composition in accordance with claim 1 wherein the resin selected exhibits a peak value molecular weight in each of the molecular weight regions of from about 20,000 to about 80,000, and from about 100,000 to about 300,000.

13. A developer composition comprised of the toner composition of claim 1 and carrier particles.

14. A developer composition in accordance with claim 13 wherein the carrier particles contain a polymeric coating thereover.

15. A developer composition in accordance with claim 13 wherein the carrier particles consist of a steel core coated with a fluoropolymer.

16. A developer composition in accordance with claim 13 wherein the pigment particles are selected from the group consisting of carbon black, cyan, magenta, yellow, red, blue, brown, green, and mixtures thereof present in an amount of from about 2 to about 15 percent by weight.

17. A method for developing images which comprises forming an electrostatic latent image on a negatively charged imaging member, contacting the image with toner composition of claim 1, followed by transferring the image to a suitable substrate, and subsequently affixing the image thereto.

18. A method of imaging in accordance with claim 17 wherein the wax is selected from polypropylene, polyethylene, or mixtures thereof.

19. A method of imaging in accordance with claim 17 wherein the process is accomplished in the absence of a silicone oil release fluid, and there results no offsetting of the resulting images.

20. A toner composition in accordance with claim 1 wherein R is an alkyl group of from about 12 carbon atoms to about 22 carbon atoms, $R_1$ is an alkyl group from about 14 carbon atoms to about 18 carbon atoms, and n is the number 3.

21. A toner composition in accordance with claim 1 wherein for the charge enhancing additive R is an alkyl group of from about 12 carbon atoms to about 18 carbon atoms, $R_1$ is an alkyl group of from about 14 carbon atoms to about 18 carbon atoms, and n is the number 4.

22. A toner composition in accordance with claim 1 wherein for the charge enhancing additive $R_2$ and $R_3$ are methyl groups.

23. A toner composition in accordance with claim 1 wherein for the charge enhancing additive $R_4$ is a methylene group.

24. A developer composition in accordance with claim 13 wherein the resin particles are selected from the group consisting of polyesters, styrene butadiene copolymers, and styrene methacrylate copolymers.

25. A developer composition in accordance with claim 13 wherein the wax selected is of a weight average molecular weight of from about 500 to about 20,000.

26. A developer composition in accordance with claim 13 wherein the wax is selected from the group consisting of polypropylene and polyethylene.

27. A toner composition in accordance with claim 1 wherein there is selected a mixture of resin particles.

28. A toner composition in accordance with claim 1 wherein there is selected at least one resin polymer exhibiting a peak molecular weight in each of the molecular weight regions of from about 5,000 to about 80,000, and from about 100,000 to about 300,000.

29. A developer composition in accordance with claim 14 wherein the coating is comprised of a mixture of fluoropolymers and vinyl chloride.

30. A developer composition in accordance with claim 14 wherein the coating is comprised of a mixture of fluoropolymers and polymethyl methacrylates.

31. A developer composition in accordance with claim 14 wherein the coating is comprised of a mixture of polyvinylidine fluoride and vinyl chloride.

* * * * *